US006511353B2

(12) United States Patent
Champion et al.

(10) Patent No.: US 6,511,353 B2
(45) Date of Patent: Jan. 28, 2003

(54) CONNECTOR HAVING A PLURALITY OF RIGHT ANGLED CONTACT ELEMENTS

(75) Inventors: Patrick Champion, Change (FR); Dominique Etiembre, Spay (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 10/014,175

(22) Filed: Dec. 11, 2001

(65) Prior Publication Data

US 2002/0086592 A1 Jul. 4, 2002

(30) Foreign Application Priority Data

Dec. 13, 2000 (FR) ..... 00 17069

(51) Int. Cl.[7] ..... H01R 9/24
(52) U.S. Cl. ..... 439/891; 439/79; 439/701
(58) Field of Search ..... 439/891, 79, 80, 439/701

(56) References Cited

U.S. PATENT DOCUMENTS 5,490,787 A * 2/1996 Bowman et al. ..... 439/79
5,593,307 A * 1/1997 Bale et al. ..... 439/567
5,794,336 A 8/1998 Hopson et al. ..... 29/882
6,095,826 A * 8/2000 Potters ..... 439/79
6,129,592 A 10/2000 Mickievicz et al. ..... 439/701

* cited by examiner

*Primary Examiner*—Albert W. Paladini
*Assistant Examiner*—Tuan Dinh
(74) *Attorney, Agent, or Firm*—Perman & Green, LLP

(57) ABSTRACT

A connector comprises a housing of insulating material and a number of right-angled contact elements arranged in rows and columns. The contact elements are provided with a contact end, an intermediate elbow part and a termination for connection to a printed circuit board. The housing includes a first housing section accommodating the contact ends of the contact elements, and a second housing section accommodating the elbow parts. The second housing section comprises upper and lower walls, and support walls extending mainly parallel to the upper and lower walls between adjacent rows of contact elements for supporting the intermediate elbow parts of the rows of contact elements. The second housing section is provided with at least one intermediate wall extending transverse to the support walls between the elbow parts of two adjacent columns of contact elements.

11 Claims, 1 Drawing Sheet

CONNECTOR HAVING A PLURALITY OF RIGHT ANGLED CONTACT ELEMENTS

BACKGROUND OF THE INVENTION

1. Field of the Invention

This invention relates to a connector, and more particularly to the type of connector comprising a housing of insulating material and a number of right-angled contact elements arranged in rows and columns.

2. Description of Prior Developments

EP-A-0 649 195 discloses a connector of the above type, wherein the second housing section comprises lateral walls having a thickness corresponding to half of the pitch between adjacent contact elements in row direction to allow stackability of the connectors. With decreasing pitch between adjacent contact elements, the thin lateral walls can be deformed easily during mounting of the connector on a printed circuit board, in particular in case of contact element terminations of the press-fit type. Moreover, moulding thin walls presents a difficulty during manufacturing.

SUMMARY OF THE INVENTION

A connector according to the invention comprises a housing of insulating material and a number of right-angled contact elements arranged in rows and columns, the contact elements having a contact end, an intermediate elbow part and a termination for connection to a printed circuit board, the housing having a first housing section accommodating the contact ends of the contact elements, and a second housing section accommodating the elbow parts, wherein the second housing section comprises upper and lower walls, and support walls extending mainly parallel to the upper and lower walls between adjacent rows of contact elements for supporting the intermediate elbow parts of the rows of contact elements. The invention described herein aims to provide an improved connector of the type described herein. To this end the connector according to the invention is characterized in that the second housing section is provided with at least one intermediate wall extending transverse to the support walls between the elbow parts of two adjacent columns of contact elements.

In this manner a connector is obtained, wherein the intermediate wall can have a thickness corresponding to the free space between two adjacent columns of contact elements, i.e. twice the thickness of the lateral walls of the prior art connector. This results in an improvement of the moulding process of the second housing section. Furthermore, the strength of the intermediate wall is much higher so that relatively high forces exerted during mounting the connector on a printed circuit board can be taken without any deformation of the intermediate wall.

According to the invention, the second housing section is provided with lateral walls parallel to the at least one intermediate wall and having half the thickness of the at least one intermediate wall, said lateral walls extending substantially only along the support walls. In this manner the second housing section is provided with lateral wall parts only covering the elbow part sections aligned with the contact ends of the contact elements so that the elbow part sections aligned with the terminations are clearly visible for the operator of the manufacturing process. In this manner the positioning of the connector on a printed circuit board can be visually inspected in an easy manner.

Preferably the at least one intermediate wall comprises a rear support at its lower end opposite of the first housing section, wherein the rear support is provided with a support face preferably located in one plane with the lower surface of the lower wall of the second housing section. In this manner the intermediate wall together with the lower wall provides a strong support for positioning the connector horizontally with respect to the printed circuit board. Any lift or rotation of the housing of the connector with respect to the printed circuit board is effectively prevented.

BRIEF DESCRIPTION OF THE DRAWINGS

The accompanying drawings, which are incorporated in and constitute a part of the specification illustrate one embodiment of the invention and, together with the description herein, serve to explain the principles of the invention.

DESCRIPTION OF THE PREFERRED EMBODIMENTS

Figure 1:
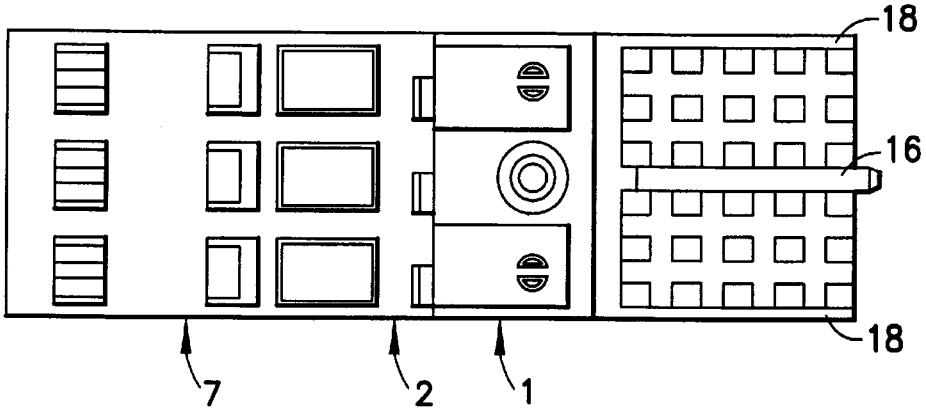
FIG. 1 is a bottom plan view of an embodiment of the connector of the invention.
Figure 2:
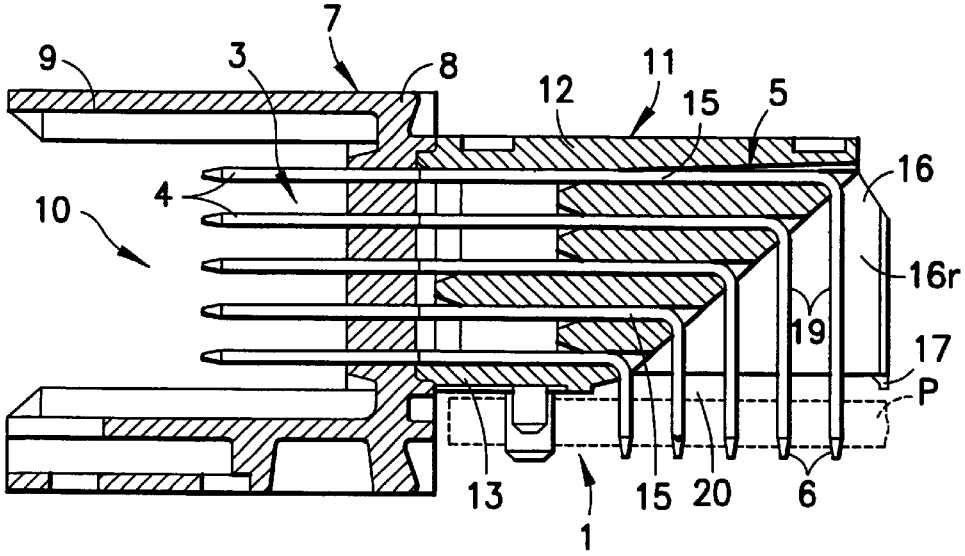
FIG. 2 is a longitudinal sectional view of the connector of FIG. 1, and a printed circuit board (in phantom)
Figure 4:
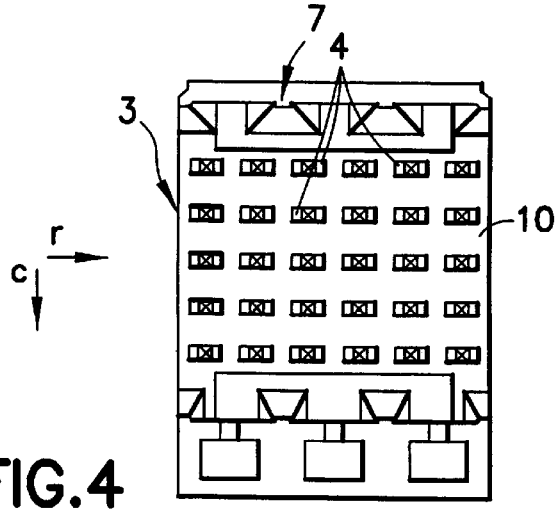
FIG. 4 is a front plan view the connector of FIG. 1.

FIG. 1 illustrates a connector 1 comprising a housing 2 of insulating material and a number of right-angled contact elements 3 arranged in rows r and columns c (see FIG. 4). The contact elements fully shown in the longitudinal section of FIG. 2, are provided with a contact end 4, an intermediate elbow part 5 and a termination 6 for connection to a printed circuit board p (shown in phantom in FIG. 2 for example purposes only). In the embodiment shown, the terminations 6 are made as press-fit terminations. It will be understood that other types of terminations can be used, such as surface mount terminations or the like.

The housing 2 comprises a first or front housing section 7 having an U-shaped cross-section as shown in FIG. 2 with a bottom wall 8 and side walls 9. The first housing section 7 determines a receiving space 10 for a mating connector not shown. The first housing section 7 accommodates the contact ends 4 of the contact elements 3.

The housing 2 further comprises a second or rear housing section 11 accommodating the elbow parts 5 of the contact elements 3. This second housing section 11 comprises a long upper wall 12 and a shorter lower wall 13. Support walls 14 extend mainly parallel to the upper and lower walls 12,13 between adjacent rows of contact elements 3 for supporting the intermediate elbow parts 5 in particular the elbow part sections 15 aligned with the contact ends 4.

As can be seen in FIGS. 1 and 2 in particular, the second housing section 11 is provided with one intermediate wall 16 located centrally between the elbow parts 5 of the two central columns of contact elements 3. The thickness of this central intermediate wall 16 corresponds with the space between the two adjacent columns of contact elements 3. In this manner the intermediate wall 16 is relatively thick, so that the complete second housing section 11 can be manufactured by injection moulding as an integral component in a relatively easy manner. Further, the relatively thick intermediate wall provides a high strength to the second housing section 11. The intermediate wall 16 is provided with a rear support 17 at its lower end opposite of the first housing section 7. This rear support 17 is provided with a support face located in one plane with the lower face of the lower wall 13. In this manner the central intermediate wall 16 rests on the printed circuit board together with the lower face of the lower wall 13 avoiding any lift or rotation of the housing 2 with respect to the printed circuit board when the terminations 6 are inserted in to the printed circuit board. High forces can be taken by the intermediate wall 16 without any deformation.

Figure 3:
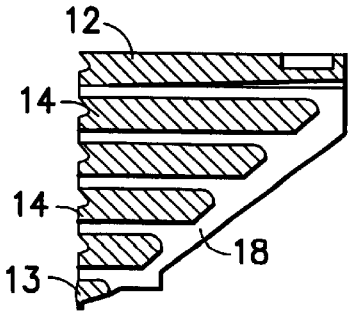
FIG. 3 is a longitudinal sectional view of the second housing section of the connector of FIG. 1 showing a lateral wall.

As shown in FIG. 3, the second housing section 11 is further provided with lateral walls 18 extending parallel to the intermediate wall 16 and having half the thickness of this intermediate wall 16 thereby allowing stackability of a number of connectors 1. These lateral walls 18 extend substantially only along the support walls 14 thereby allowing free visibility of the vertical sections 19 of the elbow parts 5, i.e. those sections aligned with the terminations 6. In this manner the correct positioning of the contact elements 3 on the printed circuit board can be inspected visually in an easy manner. Preferably the lateral walls 18 extend obliquely downwardly from the upper wall 12 towards the lower wall 13 as shown in FIG. 3.

In the embodiment shown in FIG. 2, the intermediate wall 16 is provided with a recess 20 at its lower side between the support 14 and the lower wall 13. If desired, for example depending on the number of columns of contact elements, the second housing section 11 may comprise two or more intermediate walls between adjacent columns of contact elements. As can be realized from FIGS. 2 and 3, the rear portion **16*r* with support 17 thereon of the intermediate wall extends beyond the later walls 18**.

While this invention has been described in conjunction with a specific embodiment thereof, it should be evident that many alternatives and modifications can be devised by those skilled in the art without departing from the invention. Accordingly, the present invention is intended to embrace all such alternatives, modifications and variances which fall within the scope of the appended claims.

What is claimed is:

1. A connector, comprising a housing of insulating material and a number of right-angled contact elements arranged in rows and columns, said contact elements having contact ends, intermediate elbow parts and terminations for connection to a printed circuit board, said housing having a first housing section accommodating the contact ends of the contact elements, and a second housing section accommodating the elbow parts, wherein said second housing section comprises upper and lower walls, outer lateral walls between the upper and lower walls, and support walls extending mainly parallel to the upper and lower walls between adjacent rows of contact elements for supporting the intermediate elbow parts of the rows of contact elements, characterized in that the second housing section is provided with at least one intermediate wall extending transverse to the support walls between the elbow parts of two adjacent columns of contact elements, and having a portion extending beyond the lateral walls.

2. A connector according to claim 1, wherein one intermediate wall is provided centrally between said elbow parts of two central columns of contact elements.

3. A connector according to claim 1, wherein said lateral walls are parallel to said at least one intermediate wall and having half the thickness of said at least one intermediate wall, said lateral walls extending substantially only along said support walls.

4. A connector according to claim 3, wherein said lateral walls extend obliquely downwardly from said upper wall to said lower wall.

5. A connector according to claim 1, wherein said second housing section is an integral component.

6. A connector according claim 1, wherein said at least one intermediate wall comprises a rear support at its lower end opposite of said first housing section, wherein said rear support is provided with a support face preferably located in one plane with a lower surface of said lower wall of said second housing section.

7. A connector according to claim 1, wherein the portion of the at least one intermediate wall extending beyond the later walls is disposed so that when the connector is mounted on the printed circuit board, the portion contacts the printed circuit board providing a support on the second housing section in an area along the second housing section where the lateral walls do not extend.

8. A connector according to claim 6, wherein said at least one intermediate wall is provided with a recess at its lower side.

9. A connector according to claim 5, wherein said integral component is an injection molded component.

10. A connector, comprising a housing of insulating material and a number of right-angled contact elements arranged in rows and columns, said contact elements having contact ends, intermediate elbow parts and terminations for connection to a printed circuit board, said housing having a first housing section accommodating the contact ends of the contact elements, and a second housing section accommodating the elbow parts, wherein said second housing section comprises upper and lower walls, and support walls extending mainly parallel to the upper and lower walls between adjacent rows of contact elements for supporting the intermediate elbow parts of the rows of contact elements, further wherein the second housing section is provided with at least one intermediate wall extending transverse to the support walls between the elbow parts of two adjacent columns of contact elements, the second housing section being provided with outer lateral walls parallel to the at least one intermediate wall and having half the thickness of the at least one intermediate wall, the lateral walls extending substantially only along the support walls.

11. A connector, comprising a housing of insulating material and a number of right-angled contact elements arranged in rows and columns, said contact elements having contact ends, intermediate elbow parts and terminations for connection to a printed circuit board, said housing having a first housing section accommodating the contact ends of the contact elements, and a second housing section accommodating the elbow parts, wherein said second housing section comprises upper and lower walls, and support walls extending mainly parallel to the upper and lower walls between adjacent rows of contact elements for supporting the intermediate elbow parts of the rows of contact elements, further wherein the second housing section is provided with at least one intermediate wall extending transverse to the support walls between the elbow parts of two adjacent columns of contact elements, the second housing section being provided with lateral walls parallel to the at least one intermediate wall and having half the thickness of the at least one intermediate wall, the lateral walls extending substantially only along the support walls, the at least one intermediate wall comprises a rear support projecting from a surface of the at least one intermediate wall at its lower end opposite of the first housing section, wherein the rear support is provided with a support face located in one plane with the lower surface of the lower wall of the second housing section.

* * * * *